US010137656B2

(12) United States Patent
Lundgren et al.

(10) Patent No.: US 10,137,656 B2
(45) Date of Patent: Nov. 27, 2018

(54) CARTON FEEDER SYSTEM AND METHOD FOR SIMULTANEOUSLY FEEDING A PLURALITY OF CARTONS TO A CONVEYOR TRACK USING A PLURALITY OF PICK-UP HEADS

(75) Inventors: Christer Lundgren, Kalmar (SE); Jan Nilsson, Kalmar (SE)

(73) Assignee: Norden Machinery AB, Kalmar (SE)

( * ) Notice: Subject to any disclaimer, the term of this patent is extended or adjusted under 35 U.S.C. 154(b) by 39 days.

(21) Appl. No.: 13/643,012

(22) PCT Filed: Apr. 26, 2011

(86) PCT No.: PCT/SE2011/050498
§ 371 (c)(1),
(2), (4) Date: Oct. 23, 2012

(87) PCT Pub. No.: WO2011/136726
PCT Pub. Date: Nov. 3, 2011

(65) Prior Publication Data

US 2013/0039731 A1 Feb. 14, 2013

(30) Foreign Application Priority Data

Apr. 27, 2010 (SE) ..... 1050417

(51) Int. Cl.
*B31B 50/00* (2017.01)
*B65B 43/26* (2006.01)
(Continued)

(52) U.S. Cl.
CPC ..... *B31B 50/00* (2017.08); *B31B 50/062* (2017.08); *B31B 50/788* (2017.08);
(Continued)

(58) Field of Classification Search
CPC ..... B31B 50/00; B31B 50/062; B31B 50/788; B31B 2100/0022; B65B 43/265;
(Continued)

(56) References Cited

U.S. PATENT DOCUMENTS 3,242,827 A 3/1966 Winters
3,633,470 A 1/1972 Bingham
(Continued)

FOREIGN PATENT DOCUMENTS

DE 1022959 B1 1/1958
DE 4414018 A1 11/1994
(Continued)

OTHER PUBLICATIONS

"International Application Serial No. PCT/SE2011/050498, International Search Report dated Jun. 27, 2011", 6 pgs.
(Continued)

*Primary Examiner* — Sameh Tawfik
(74) *Attorney, Agent, or Firm* — Schwegman, Lundberg & Woessner, P.A.

(57) ABSTRACT

Embodiments include a carton feeding system for feeding a plurality of cartons to a conveyor track, comprising a plurality of feeding devices, where each feeding device comprises a pick-up head with a plurality of vacuum cups, and an erecting finger pivotally suspended at the pick-up head, where the pick-up head has a pick-up position (P1) in which the holding plane of the pick-up head is positioned parallel to the folded carton blank that is to be picked up, and an insertion position (P2) in which the erecting finger is pivoted with respect to the holding plane of the pick-up head in such a way that the carton is opened, and where at least two cartons are inserted simultaneously into the conveyor track.

12 Claims, 12 Drawing Sheets

(51) Int. Cl.

| | |
|---|---|
| *B65B 43/30* | (2006.01) |
| *B65B 43/32* | (2006.01) |
| *B65H 3/08* | (2006.01) |
| *B31B 50/06* | (2017.01) |
| *B31B 50/78* | (2017.01) |
| *B31B 100/00* | (2017.01) |

(52) U.S. Cl.
CPC ..... *B31B 2100/0022* (2017.08); *B65B 43/265* (2013.01); *B65B 43/305* (2013.01); *B65B 43/325* (2013.01); *B65H 3/0883* (2013.01); *B65H 2301/42322* (2013.01); *B65H 2403/543* (2013.01); *B65H 2405/36* (2013.01)

(58) Field of Classification Search
CPC ..... B65B 43/305; B65B 43/325; B65H 2301/42322; B65H 2405/36; B65H 3/0883
USPC ..... 493/428, 315, 313, 318, 319, 309
See application file for complete search history.

(56) References Cited

U.S. PATENT DOCUMENTS

| | | | | |
|---|---|---|---|---|
| 3,956,976 | A | 5/1976 | Vogel et al. | |
| 4,011,799 | A | 3/1977 | Chidsey | |
| 4,194,442 | A * | 3/1980 | Martelli | 493/316 |
| 4,331,436 | A | 5/1982 | Kuttenbaum et al. | |
| 4,518,301 | A * | 5/1985 | Greenwell | 414/795.7 |
| 4,537,587 | A | 8/1985 | Langen | |
| 4,871,348 | A * | 10/1989 | Konaka | 493/315 |
| 4,881,934 | A * | 11/1989 | Harston et al. | 493/315 |
| 5,024,640 | A | 6/1991 | Saitoh | |
| 5,049,119 | A | 9/1991 | Bershadsky | |
| 5,061,231 | A * | 10/1991 | Dietrich et al. | 493/315 |
| 5,078,669 | A | 1/1992 | Dietrich et al. | |
| 5,102,385 | A | 4/1992 | Calvert | |
| 5,215,515 | A * | 6/1993 | Bershadsky | 493/315 |
| 5,298,008 | A | 3/1994 | Decker et al. | |
| 5,411,464 | A | 5/1995 | Calvert et al. | |
| 5,573,490 | A | 11/1996 | Steinbrenner et al. | |
| 5,613,828 | A | 3/1997 | Haddow et al. | |
| 5,662,577 | A | 9/1997 | Reuteler | |
| 5,687,874 | A | 11/1997 | Omori et al. | |
| 5,713,187 | A | 2/1998 | Peterson et al. | |
| 6,168,149 | B1 * | 1/2001 | Boldrini | 271/107 |
| 6,503,180 | B1 | 1/2003 | Plueschow et al. | |
| 6,669,616 | B1 | 12/2003 | Bierenacki et al. | |
| 6,699,165 | B1 | 3/2004 | Krieger et al. | |
| 6,764,436 | B1 | 7/2004 | Mazurek et al. | |
| 7,310,925 | B2 | 12/2007 | Monti | |
| 7,328,561 | B2 | 2/2008 | Fochler | |
| 7,695,421 | B2 * | 4/2010 | Ford | 493/315 |
| 8,686,222 | B2 | 4/2014 | Samuel et al. | |
| 2013/0121799 | A1 * | 5/2013 | Lundgren et al. | 414/752.1 |

FOREIGN PATENT DOCUMENTS

| | | | |
|---|---|---|---|
| DE | 10114044 | A1 | 10/2002 |
| EP | 0425226 | A1 | 5/1991 |
| EP | 0331325 | B1 | 11/1994 |
| EP | 0900753 | A2 | 3/1999 |
| EP | 1174256 | A2 | 1/2002 |
| EP | 0800450 | B1 | 10/2003 |
| EP | 1594745 | B1 | 10/2006 |
| GB | 846891 | A | 8/1960 |
| GB | 2053133 | A | 2/1981 |
| GB | 2429965 | A | 3/2007 |
| JP | 11-079134 | A | 3/1999 |
| JP | 2002-544067 | A | 12/2002 |
| JP | 2009-012303 | A | 1/2009 |
| JP | 2013-507919 | A | 3/2013 |
| WO | WO-00/23325 | A1 | 4/2000 |

OTHER PUBLICATIONS

"International Application Serial No. PCT/SE2011/050498, Written Opinion dated Jun. 27, 2011", 5 pgs.
"U.S. Appl. No. 13/643,025, Final Office Action dated Dec. 6, 2013", 6 pgs.
"U.S. Appl. No. 13/643,025, Non Final Office Action dated Jul. 22, 2013", 6 pgs.
"U.S. Appl. No. 13/643,025, Response filed Jul. 10, 2013 to Restriction Requirement dated Jun. 11, 2013", 8 pgs.
"U.S. Appl. No. 13/643,025, Response filed Nov. 22, 2013 to Non Final Office Action dated Jul. 22, 2013", 15 pgs.
"U.S. Appl. No. 13/643,025, Restriction Requirement dated Jun. 11, 2013", 5 pgs.
"International Application Serial No. PCT/SE2011/050497, International Preliminary Report on Patentability dated Apr. 11, 2012", 9 pgs.
"International Application Serial No. PCT/SE2011/050497, International Search Report dated Aug. 15, 2011", 8 pgs.
"International Application Serial No. PCT/SE2011/050497, Response filed Feb. 27, 2012 to Written Opinion dated Aug. 15, 2011", 4 pgs.
"International Application Serial No. PCT/SE2011/050497, Written Opinion dated Aug. 15, 2011", 5 pgs.
"International Application Serial No. PCT/SE2011/050498, International Preliminary Report on Patentability dated Oct. 30, 2012", 5 pgs.
"Machine Translation of DE1022959, issued Jan. 16, 1958", (Specification and Claims), 4 pgs.
"U.S. Appl. No. 13/643,025, Response filed Nov. 4, 2014 to Non Final Office Action dated Aug. 1, 2014", 9 pgs.
"U.S. Appl. No. 13/643,025, Non Final Office Action dated Aug. 1, 2014", 5 pgs.
"U.S. Appl. No. 13/643,025, Preliminary Amendment dated Oct. 23, 2012", 7 pgs.
"U.S. Appl. No. 13/643,025, Advisory Action dated Mar. 13, 2015", 3 pgs.
"U.S. Appl. No. 13/643,025, Appeal Brief filed May 19, 2015", 16 pgs.
"U.S. Appl. No. 13/643,025, Decision on Pre-Appeal Brief Request dated Apr. 15, 2015", 2 pgs.
"U.S. Appl. No. 13/643,025, Final Office Action dated Nov. 20, 2014", 7 pgs.
"U.S. Appl. No. 13/643,025, Pre-Appeal Brief Request filed Mar. 19, 2015", 5 pgs.
"U.S. Appl. No. 13/643,025, Response filed Feb. 20, 2015 to Final Office Action dated Nov. 20, 2014", 11 pgs.
"Chinese Application Serial No. 201180021241.9, Second Office Action dated May 22, 2015", (English Translation), 9 pgs.
"Japanese Application Serial No. 2013-507919, Office Action dated Jan. 5, 2015", (w/ English Translation), 6 pgs.
"U.S. Appl. No. 13/643,025, Appeal Decision dated May 3, 2016", 9 pgs.
"U.S. Appl. No. 13/643,025, Notice of Allowance dated Jul. 20, 2016", 7 Pgs.
"Indonesian Application Serial No. W00201204211. Office Action dated Jun. 9, 2016", (w/concise description of relevance), 3 pgs.
"U.S. Appl. No. 13/643,025, Final Office Action dated May 26, 2017", 7 pgs.
"U.S. Appl. No. 13/643,025, Non Final Office Action dated Feb. 15, 2017", 6 pgs.
"U.S. Appl. No. 13/643,025, Response filed May 15, 2017 to Non Final Office Action dated Feb. 15, 2017", 7 pgs.
"U.S. Appl. No. 13/643,025, Response filed Mar. 6, 2014 to Final Office Action dated Dec. 6, 2013", 10 pgs.
"U.S. Appl. No. 13/643,025, Advisory Action dated Sep. 1, 2017", 3 pgs.
"U.S. Appl. No. 13/643,025, Examiner Interview Summary dated Aug. 11, 2017", 1 pg.
"U.S. Appl. No. 13/643,025, Response filed Aug. 24, 2017 to Final Office Action dated May 26, 2017", 10 pgs.

* cited by examiner

CARTON FEEDER SYSTEM AND METHOD FOR SIMULTANEOUSLY FEEDING A PLURALITY OF CARTONS TO A CONVEYOR TRACK USING A PLURALITY OF PICK-UP HEADS

RELATED APPLICATIONS

This application is a nationalization under 35 U.S.C. § 371 from International Application Serial No. PCT/SE2011/050498, filed Apr. 26, 2011 and published as WO 2011/136726 A1 on Nov. 3, 2011, which claims the priority benefit of Sweden Application Serial No. 1050417-3, filed Apr. 27, 2010, the contents of which applications and publication are incorporated herein by reference in their entirety.

TECHNICAL FIELD

Carton feeder system and method for simultaneously feeding a plurality of cartons to a conveyor track using a plurality of pick-up heads.

BACKGROUND ART

In the industry concerned with packing smaller objects such as tubes, bottles and the like in carton boxes, there is a constant need to increase the productivity of the packing machines. One aspect of a packing machine is the number of units that the machine can handle during a specific time interval. There are different ways of achieving a higher throughput in such a machine. One way is to reduce the cycle time for each object, i.e. to allow more objects to pass the machine during the same time interval. Such a solution is often difficult to achieve since it may involve a redesign of the machine and at some point, it is not possible to reduce the cycle time for a specific operation. Another way to increase the throughput in a production line is to use several parallel machines, at least for some operations. Such a solution requires more space and is not as cost-effective, but may be a possibility when an older production line is to be upgrades.

One type of machine that there may be a need to improve is the machine that pick up pre-glued folded paper cartons, erects them and feeds them to a conveyor track. On the conveyor track, the cartons continue to the next station, in which a tube or the like is inserted into the carton, with or without an instruction leaflet. The side flaps of the carton is then folded and the carton is closed, eventually also sealed, and packed in larger shipping units.

EP 1594745 B1 describes a carton manipulation and feeder apparatus, which is adapted to pick up folded, pre-glued cartons from a hopper, erects them and to feed them to a conveyor track. The cartons are erected to a square shape and are inserted at the infeed end of the conveyor track. The cartons are inserted between lugs attached to the conveyor track and having a distance between them that corresponds to the width of the carton to be inserted. In order to be able to feed the carton to the conveyor track, the carton is inserted at the infeed end of the conveyor track, where the conveyor chain changes direction and is conveyed on a wheel. In this end region of the conveyor track, the lugs are angled apart due to the conveyor wheel, which allows the erected cartons to be inserted between the lugs. When the carton is inserted and the chain has moved somewhat, the lugs will be perpendicular to the conveyor chain again and will hold the carton in position.

EP 0800450 B1 describes another carton transfer assembly adapted to transfer folded cartons from a hopper, open them and transfer them to a conveyor. The cartons are opened by an extensible rod. The opened cartons are inserted in carton pockets provided between chain lugs. The length of the carton pocket is longer than the carton itself, thereby allowing the opened carton to be inserted into the carton pocket during the rotation of the rotary feeder.

U.S. Pat. No. 7,328,561 B2 describes an apparatus for erecting boxes and setting them on a conveyor. The apparatus pick up folded boxes from a magazine, erects them and inserts them into conveyor cells on a conveyor track. The cartons are erected to a square shape by an erecting element and are inserted at the infeed end of the conveyor track. The cartons are inserted between lugs attached to the conveyor track and having a distance between them that corresponds to the width of the carton to be inserted. In order to be able to feed the carton to the conveyor track, the carton is inserted at the infeed end of the conveyor track, where the conveyor chain changes direction and is conveyed on a wheel. In this end region of the conveyor track, the lugs are angled apart due to the conveyor wheel, which allows the erected cartons to be inserted between the lugs. When the carton is inserted and the chain has moved somewhat, the lugs will be perpendicular to the conveyor chain again and will hold the carton in position. The height of the rear lug is substantially lower than the front lug in order to facilitate the insertion of the box. This requires two lugs for each box.

U.S. Pat. No. 5,573,490 describes an apparatus for erecting a folding box and folding its closure tabs before it is transferred into a conveyor device. The insertion of the erected boxes into the conveyor device is not described.

U.S. Pat. No. 4,331,436 describes a device for erecting and countercollapsing boxes from preformed blanks. The erected box may then be fed to a conveyor belt having compartment dividers adapted to hold the boxes. The boxes enter at the infeed end of the conveyor belt, where the conveyor belt changes direction and is conveyed on a wheel. In this end region of the conveyor belt, the compartment dividers are angled apart due to the conveyor wheel, which allows the erected boxes to enter between the compartment dividers.

These solutions may work well for some applications, but may be inflexible, especially when the throughput of the system is to be increased. There is thus room for improvements.

DISCLOSURE OF INVENTION

An object of the invention is therefore to provide a carton feeding system comprising a plurality of pick-up heads that can insert cartons between parallel conveyor teeth. A further object of the invention is to provide a carton feeding system that can insert a plurality of cartons simultaneously in a conveyor track. A further object of the invention is to provide a method for simultaneously feeding a plurality of cartons to a conveyor track.

In a carton feeding system for feeding a plurality of cartons to a conveyor track, comprising a plurality of feeding devices, where each feeding device comprises a pick-up head with a plurality of vacuum cups, and an erecting finger pivotally suspended at the pick-up head, where the pick-up head has a pick-up position in which the holding plane of the pick-up head is positioned parallel to the folded carton blank that is to be picked up, and an insertion position in which the erecting finger is pivoted with respect to the holding plane of the pick-up head in such a way that the carton is opened, the object of the invention is achieved in that at least two cartons are inserted simultaneously into the conveyor track.

By this first embodiment of the carton feeding system according to the invention, a carton feeding system is obtained that can insert cartons simultaneously into a continuously moving conveyor track having parallel teeth. This is achieved in that the cartons are held in a rhombic shape during the insertion and that the distance between the teeth corresponds to the erected carton, or in that the cartons are inserted in a rectangular shape and that the teeth comprises resilient elements. The rhombic shape of the cartons decreases the horizontal extension of the cartons during the insertion and provides some space between the cartons and the teeth. This space constitutes the tolerance that is needed to be able to insert a carton in a holding space with the same width as the carton itself. The insertion tolerance can also be obtained with the resilient means that allows rectangular cartons to be inserted into the conveyor track.

One advantage of being able to insert cartons when the teeth are parallel is that the cartons may be inserted on the straight conveyor track and not only at the infeed region at the end of the conveyor track. This in turn makes it possible to mount several mounting devices next to each other along the conveyor track. The mounting devices can then insert cartons simultaneously which allows for an increased insertion rate of the feeding system.

The rhombic shape of the carton is preferably such that the angle $\alpha$, which is the angle between the upper wall and one of the side walls of the carton, is in the region between 50 and 80 degrees, and more preferably between 60 and 70 degrees. It is preferred to counterfold the cartons prior to the insertion, i.e. to open the cartons by more than 90 degrees, preferably in the region of between 100 to 140 degrees. This is of advantage since the carton will then be pretensioned towards a rectangular shape, instead of towards the original flat-folded shape. This in turn will make it easier to hold the erected carton in the conveyor track. A holding protrusion may be provided at one of the teeth in order to hold the carton in position. When the carton is inserted into the conveyor track, a hold down element may be used to stop the carton from escaping the conveyor track.

When the cartons are inserted in a rectangular shape, it is also of advantage to counterfold the cartons prior to the insertion. This will help the cartons to hold the rectangular shape during the insertion of objects into the carton at a later stage.

BRIEF DESCRIPTION OF DRAWINGS

The invention will be described in greater detail in the following, with reference to the embodiments that are shown in the attached drawings, in which.

MODES FOR CARRYING OUT THE INVENTION

The embodiments of the invention with further developments described in the following are to be regarded only as examples and are in no way to limit the scope of the protection provided by the patent claims. Rectangular cartons are used in the examples. Quadratic cartons may of course also be fed by the feeding device.

Figure 1:
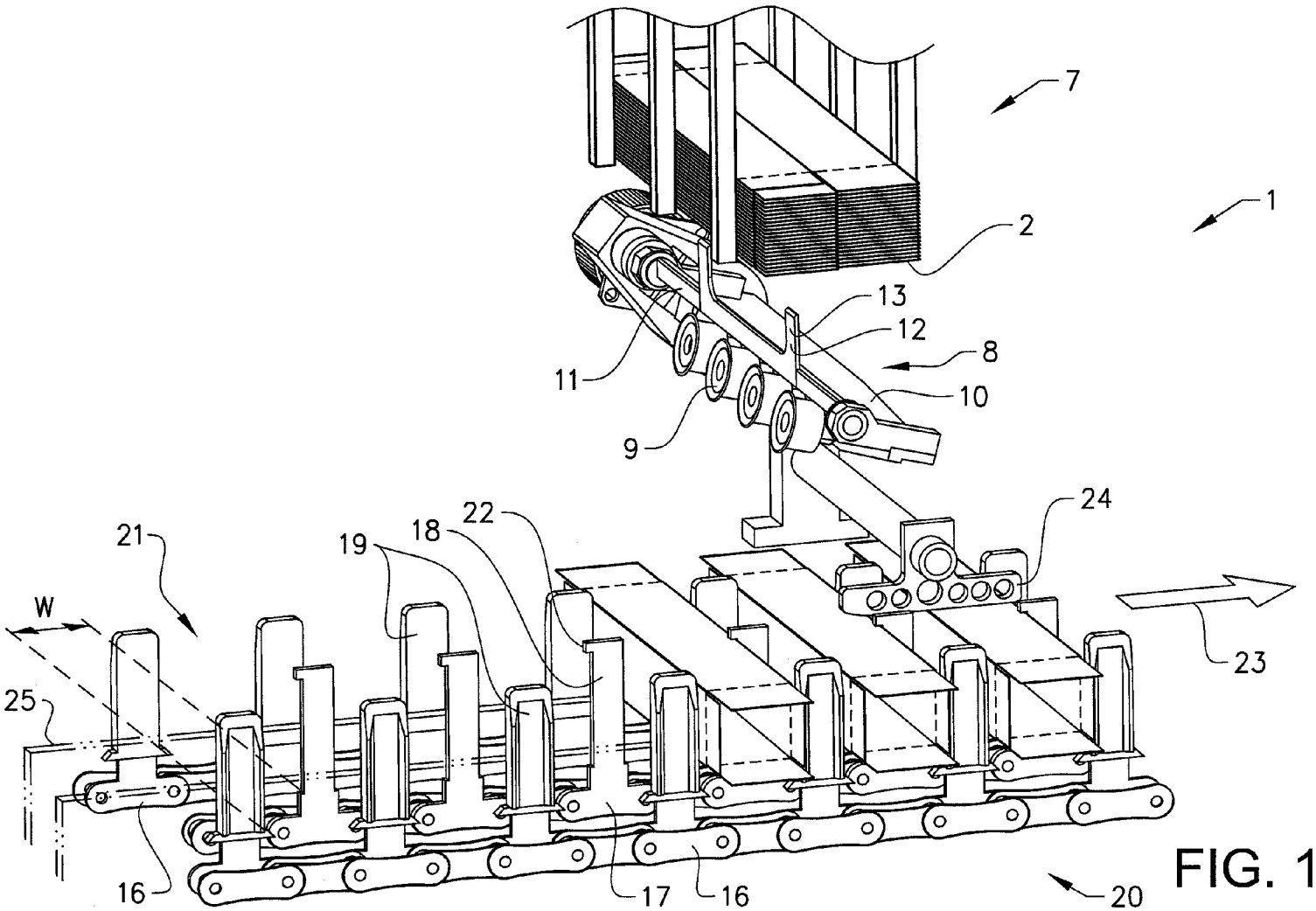
FIG. 1 shows a first embodiment of a carton feeding device used in a system according to the invention in a position before the pick-up of a carton.

FIGS. 1 to 6 shows a first embodiment of a carton feeding device 1 adapted to pick-up carton blanks 2 from a magazine, to open them and to subsequently feed them to a conveyor track. The carton blanks 2 are flat-folded, pre-glued cartons comprising four sides and having closure flaps at their end regions. When a carton blank is erected or opened, a rectangular box body is obtained, into which an object such as a tube or bottle is to be inserted, before the box is closed and/or sealed. The sides of the carton will in this description be referred to as the upper wall 3, the lower wall 4, the front wall 5 and the rear wall 6. These references indicate the directions of the sides of a carton being conveyed in the conveyor track, with reference to the moving direction of the conveyor track. The carton blanks 2 are fed from a magazine 7. The magazine is vertically disposed such that the carton blanks are removed downwards from the magazine. In FIG. 1, the magazine 7 is also shown. In the shown example, the magazine is disposed vertically such that the cartons are removed from below the magazine. One advantage of having a vertical magazine is that there is no need for feeding arrangements of any kind, since the gravity will feed the carton blanks to the magazine mouth. This will also simplify the refill of the magazine, since no hindering parts must be removed before the refilling. Another advantage of using a vertical magazine is that several carton feeding devices may be used next to each other without interfering with each other. The magazine may be angled somewhat or the cartons in the magazine may be angled somewhat in order to simplify the pick-up by the pick-up head.

Figure 7:
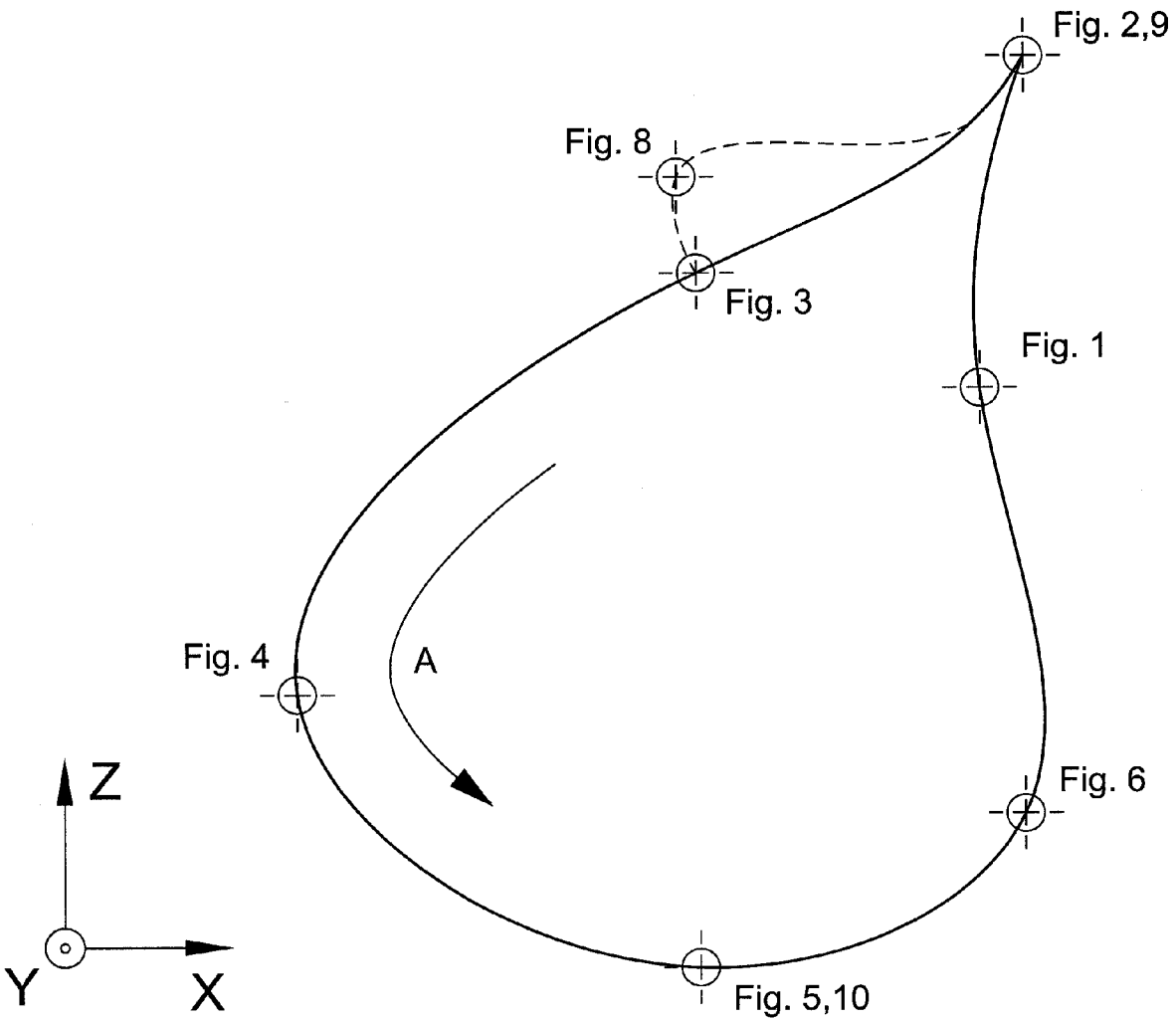
FIG. 7 shows an example of a movement path of the pick-up head.
Figure 8:
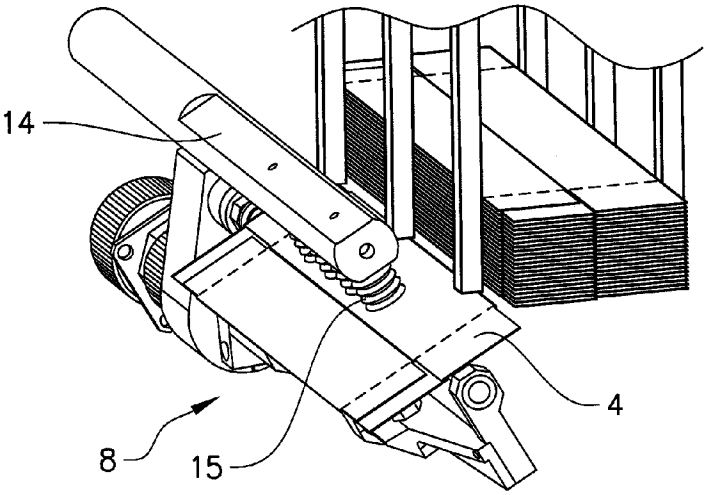
FIG. 8 shows a first embodiment of a carton feeding device used in a system according to the invention with an optional carton opening head.
Figure 8:
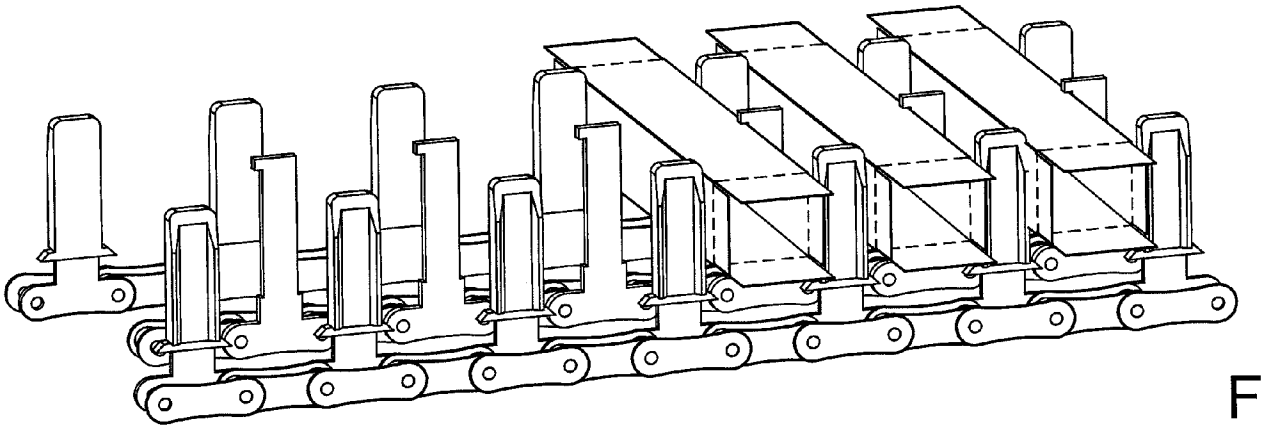

In FIG. 1, the carton feeding device is shown in a position just before a carton blank is to be picked up by the carton feeding device. The carton feeding device comprises a pick-up head 8 having a base part 10 provided with a plurality of vacuum cups 9, in the shown example four vacuum cups. The front of the vacuum cups 9 make up a holding plane of the pick-up head. An erecting shaft 11 is pivoted to the base part 10. The erecting shaft is provided with one or more erecting fingers 12, each having a bearing surface 13. The bearing surface 13 may be provided on the complete erecting finger 12 or on the front part of the finger. The bearing surface will bear on a side of a carton during the erection of the carton. The pick-up head 8 is rotatably mounted to two linearly journalled sledges (not shown), one sledge that moves in the horizontal direction and another sledge that moves in the vertical direction and that is mounted to the horizontal sledge, that will move the pick-up head 8 between the pick-up position P1, in which the carton is picked up, and the insertion position P2, in which the erected carton is released and inserted in the conveyor track. In the shown example, the pick-up head moves along a continuous, somewhat drop-shaped path. An example of such a path is shown in FIG. 7. The two independently controlled sledges allows for an easy adjustment or adaptation of the movement path, depending on the type and/or size of the carton and the speed of the conveyor track. By moving the pick-up head with a carton along a continuous path, a smooth and quick movement of the carton is obtainable. When the pick-up head 8 moves from the pick-up position to the release position, the holding plane of the pick-up head is in the shown example at the same time rotated by approximately 150 degrees. The erecting shaft is at the same time rotated with respect to the pick-up head by a predefined angle, such that the carton is erected during the transfer from the pick-up position to the insertion position.

Since the pick-up head feeds the cartons mainly in the vertical direction, from the pick-up position to the insertion position that is positioned substantially beneath the pick-up position, the pick-up head is relatively compact in the horizontal direction. This makes it possible to position several pick-up heads close to each other along the conveyor track. When the pick-up heads move along the same path simultaneously, it is possible to mount the pick-up heads such that the spacing corresponds to two cartons, i.e. such that a carton can be inserted in every other holding space of the conveyor track by the pick-up heads. With two groups of pick-up heads, it is then possible to fill all holding spaces of the conveyor track.

FIG. 1 also shows a conveyor track 20 having protruding teeth extending from the surface of the conveyor track. In this example, the conveyor track comprises two conveyor chains, an outer conveyor chain 16, in this example consisting of two chains that travel fixed to each other, and an inner chain 17 that travels together with the outer chain. In the shown example, the inner chain is made up by one chain but two chains are also common. The outer chain is provided with trailing teeth 19 that will support the rear walls of the carton. The inner chain is provided with leading teeth 18 that will support the front walls of the cartons. The distance w between two parallel trailing teeth 19 and a leading tooth 18, i.e. the relation between the outer and the inner chain, may be changed in order to allow for cartons of different sizes. Between the trailing teeth 19 and the leading tooth 18, a holding space 21 for a carton is created, in which the carton is inserted and further conveyed. The distance w corresponds to the width of the erected carton, i.e. the width of the upper wall. The use of a distance between the teeth that is the same as the width of the carton ensures that the cartons are securely held in place by the teeth during the subsequent insertion of an object into the carton. A hold down element 24 is arranged to stop the inserted cartons from escaping upwards, out of the holding space. The moving direction of the conveyor track is indicated by an arrow 23. In the conveyor track, two longitudinal rails 25 are arranged between the teeth in the lengthwise direction of the conveyor track. The height of the rails is adjustable in order to adapt the conveyor track for differently sized cartons. The cartons will ride on the rails when they are inserted in the conveyor track.

Figure 2:
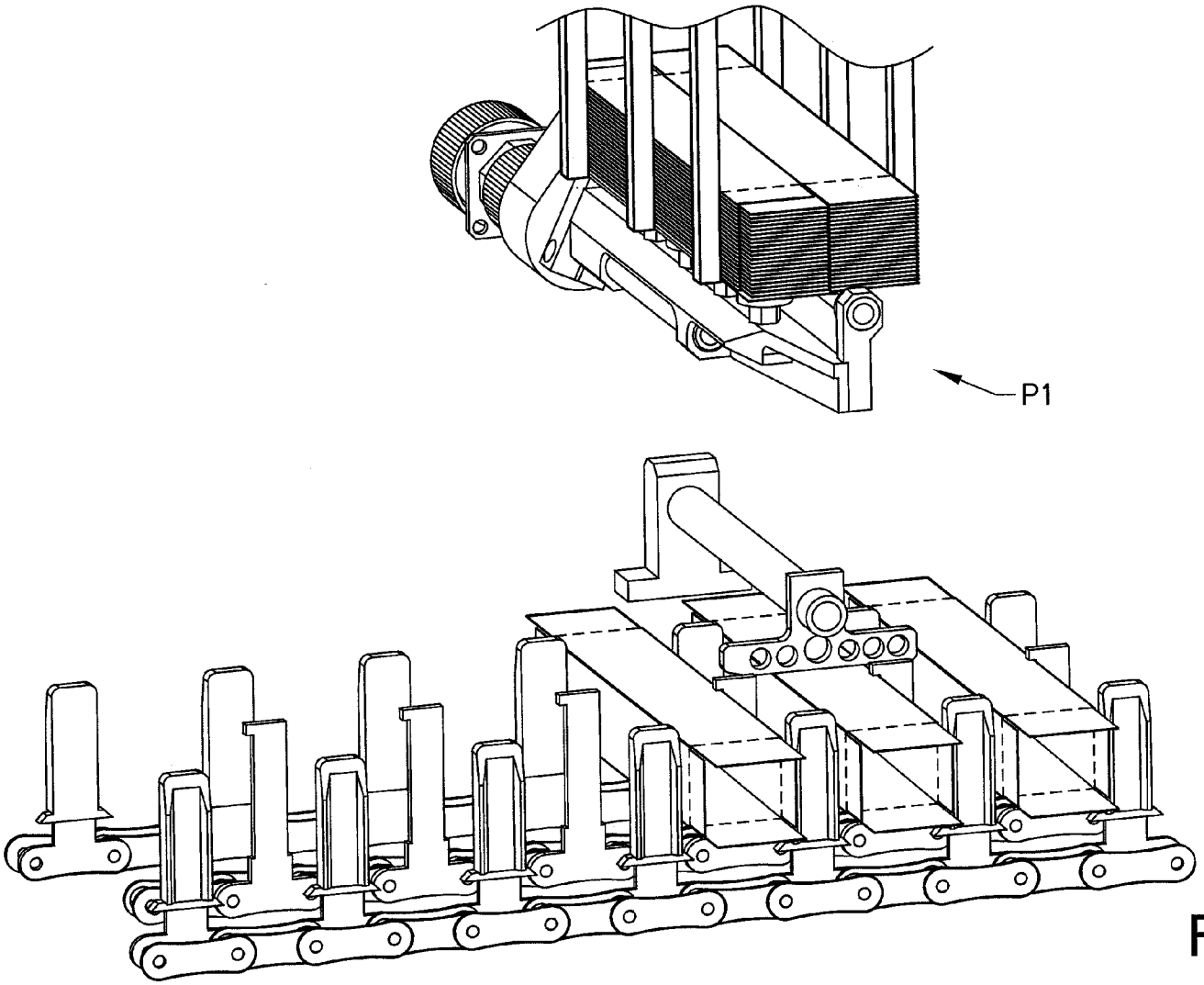
FIG. 2 shows a first embodiment of a carton feeding device used in a system according to the invention in a pick-up position.

In FIG. 2, the carton feeding device is in the pick-up position P1. In this position, the holding plane of the pick-up head, i.e. the vacuum cups 9, will bear on the upper wall 3 of the lowermost carton blank 2 in the magazine. A negative pressure is applied to the vacuum cups through suitable conduits connecting the vacuum cups to a negative pressure source. The negative pressure is controlled by a valve that in turn is controlled by the control system of the carton feeding device. The negative pressure applied to the vacuum cups will pull the carton blank out of the magazine when the pick-up head 8 continues to move. At the same time, the bearing surface of the erecting fingers will bear on the rear wall 6 of the carton blank. The bearing surface may also be positioned close to the rear wall in this position. In this example, the vacuum cups and the bearing surface of the erecting fingers are aligned with each other in substantially the same plane, which is parallel with the carton blanks arranged in the magazine.

Figure 3:
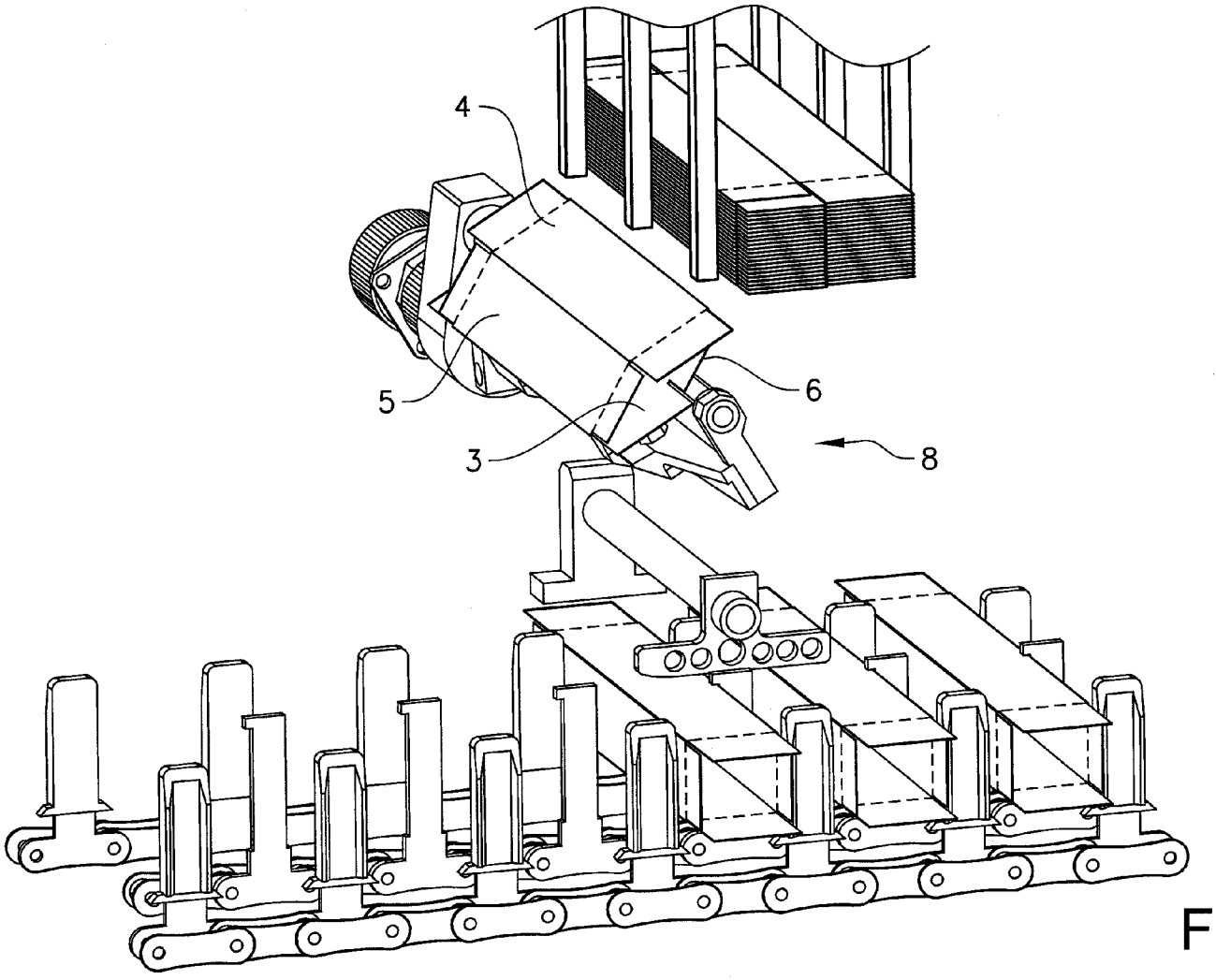
FIG. 3 shows a first embodiment of a carton feeding device used in a system according to the invention in a first intermediate position.
Figure 4:
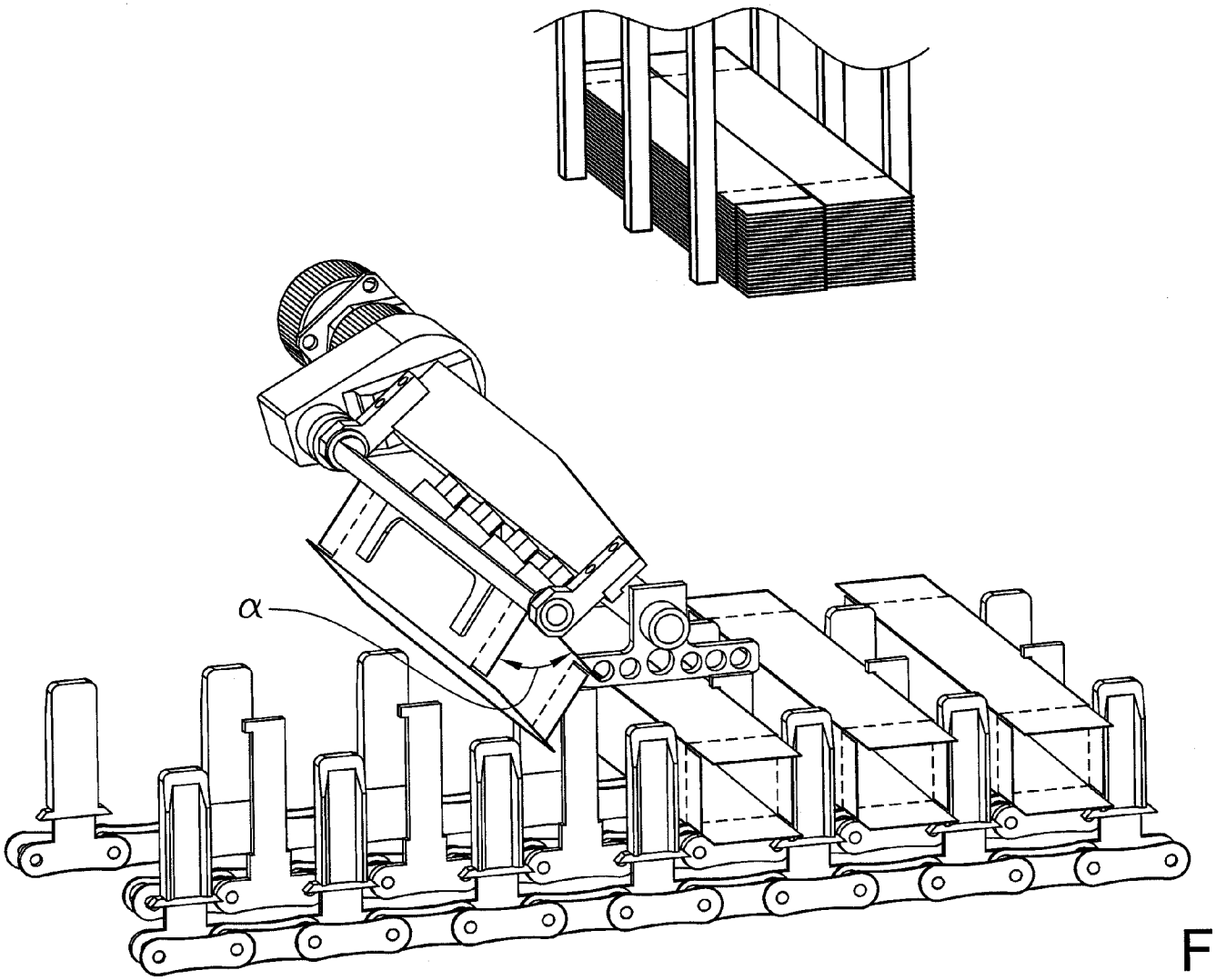
FIG. 4 shows a first embodiment of a carton feeding device used in a system according to the invention in a second intermediate position.

When the carton blank is extracted from the magazine, the pick-up head 8 continues the movement towards the insertion position. During this movement, the erecting fingers will rotate relative the pick-up head, such that the angle between the holding plane of the vacuum cups and the bearing surface of the erecting fingers will decrease. The angle between the holding plane of the vacuum cups and the bearing surface of the erecting fingers will be referred to as angle $\alpha$. In FIG. 3, a first intermediate position is shown, in which the carton is partly opened. In this position, angle $\alpha$ is around 150 degrees. The pick-up head moves in a direction against the moving direction 23 of the conveyor track during the first part of the movement path, approximately down to the position as shown in FIG. 4, which shows a second intermediate position of the pick-up head. In this position, the pick-up head starts to move in the same direction as the conveyor track and continue to move downwards somewhat. The carton is now completely open, and is in this example even counterfolded such that the angle $\alpha$ is smaller than 90 degrees and that the carton displays a rhombic shape.

In FIG. 7, an example of the movement path of the pick-up head is shown, with respect to the centre axis of the erecting shaft. The positions correspond to the positions shown in FIGS. 1 to 6 and 8 to 10. The pick-up head moves in the direction indicated by the arrow A.

Figures 5A, 5B:
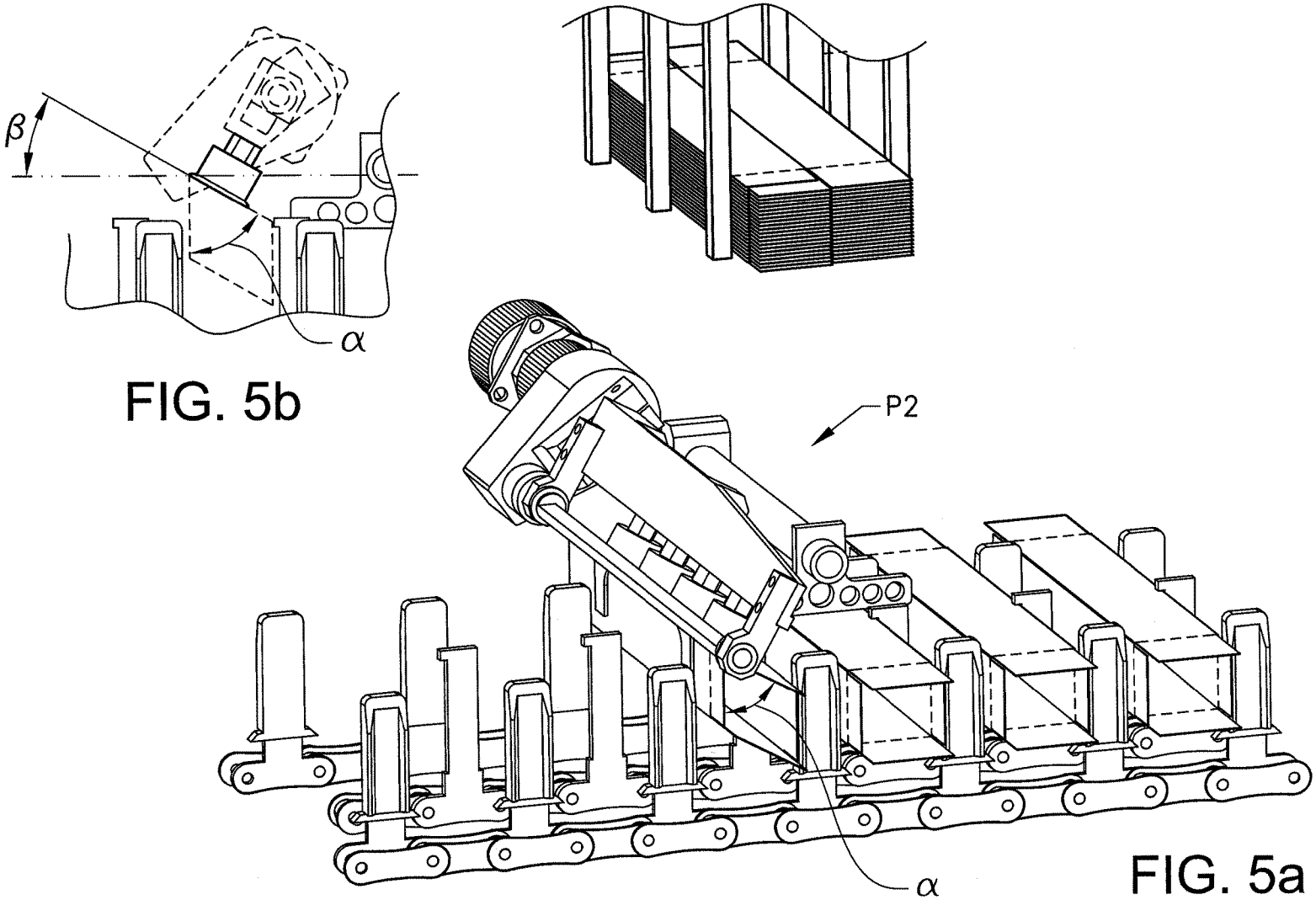
FIG. 5*a* shows a first embodiment of a carton feeding device used in a system according to the invention in an insertion position.
FIG. 5*b* shows a detail of the carton feeding device of FIG. 5*a*.

From the position shown in FIG. 4, the pick-up head continues to the insertion position shown in FIG. 5. At the same time, the carton is counterfolded somewhat more, such that the angle $\alpha$ lies in the region between 50 and 80 degrees, and preferably around 60 degrees. By counterfolding the carton in this way, the distance between the front wall 5 and the rear wall 6 of the carton will decrease. The front wall 5 and the rear wall 6 are preferably substantially vertical in the insertion position. This will in turn allow the carton to be inserted into the holding space of the conveyor track. At the same time, the pick-up head 8 is held with the holding plane at an angle $\beta$ relative to the plane of the conveyor track. This angle is approximately 30 degrees in the insertion position for the shown example, and is preferably in the range between 10 and 40 degrees. The movement of the pick-up head is synchronized with the movement of the conveyor track in order to allow the cartons to be inserted in a smooth and reliable way. The conveyor track moves continuously at a constant speed. This ensures a high throughput rate. It would also be possible to rotate the pick-up head 8 to a position in which the pick-up head is angled to the holding plane at an angle $-\beta$ relative to the plane of the conveyor track.

The pick-up head with a carton that is inserted into the holding space of the conveyor track is shown in FIG. 5. The insertion starts in the position shown in FIG. 4, where the pick-up head starts to move along the conveyor track. At the same time, the lower part of the folded carton reaches down between the teeth. The pick-up head continues the movement downwards until the lowermost position, as shown in FIG. 5, is reached. In this insertion position P2, the carton is inserted in the holding space by the pick-up head and will bear on the rails 25. The carton is consequently released from the pick-up head by removing the negative pressure from the vacuum cups. To help the release of the carton from the pick-up head, and to stop the carton from escaping the conveyor track upwards, a hold down element 24 is arranged above the conveyor track. The hold down element is mounted to the horizontal sledge of the pick-up head and moves with the pick-up head in the horizontal direction, thereby assisting the insertion of the carton. If required, the hold down element may also push the carton down somewhat in the conveyor track.

Figure 6:
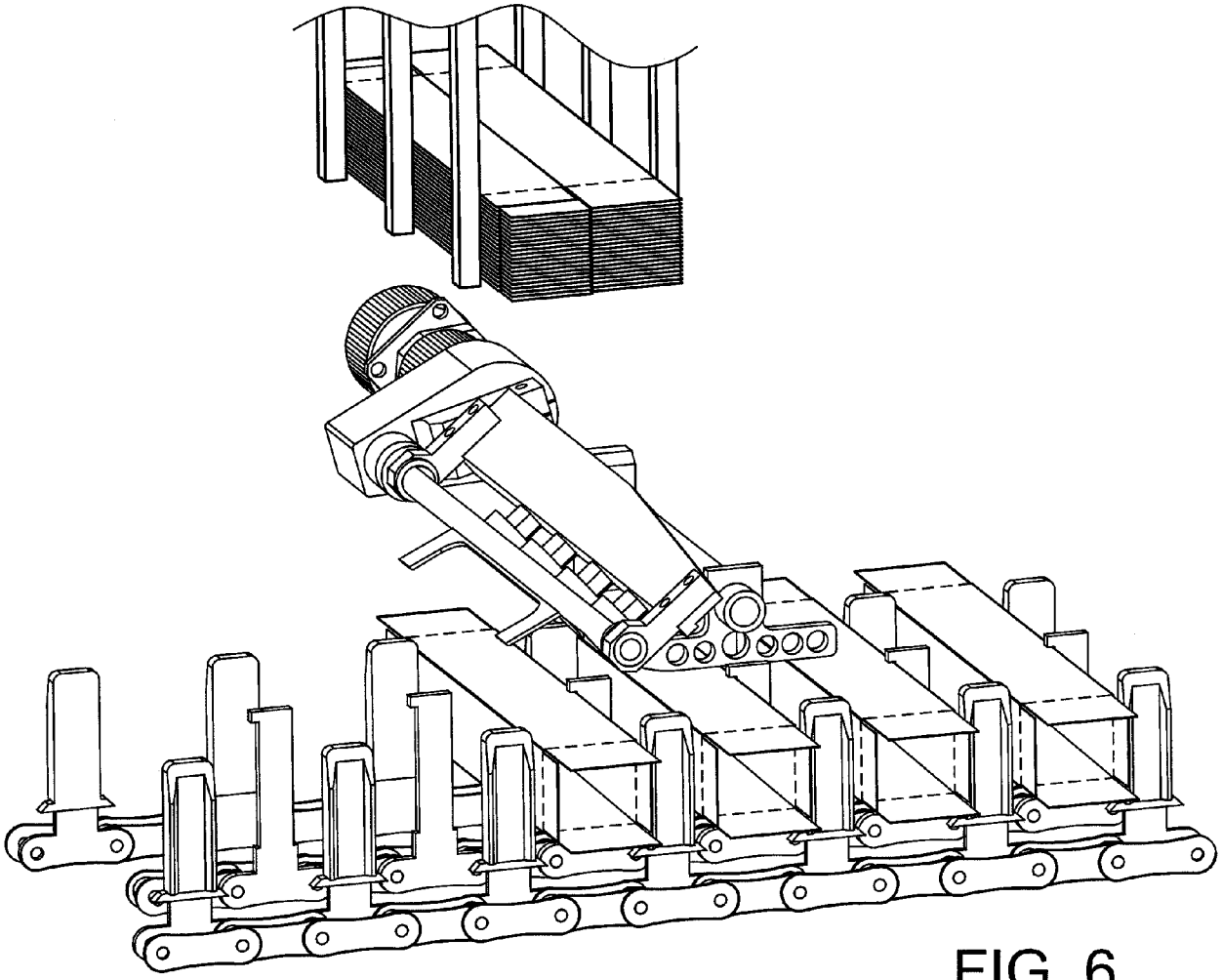
FIG. 6 shows a first embodiment of a carton feeding device used in a system according to the invention in a position after the insertion of a carton.

The pick-up head will move with more or less the same speed as the conveyor track, in the moving direction of the conveyor track, between the position as shown in FIG. 4 and the position as shown in FIG. 6. There may be a small acceleration at the beginning of this movement, but since the carton is held in a rhombic shape, there is enough tolerance between the teeth and the carton to allow this without damaging the carton. The speed will be substantially constant from the position as shown in FIG. 4 and to at least the position in which the carton is released from the pick-up head and the erecting fingers.

In the shown example, the carton is counterfolded by 30 degrees, and a suitable range for the counterfolding is between 10 to 40 degrees, depending e.g. on the speed of the conveyor track. The carton will thus have some built-in tension that will force the carton back to its rectangular shape. The carton will thus, either alone or with the aid of the hold down element, obtain its rectangular shape when it is released from the pick-up head and the erecting fingers. Since the distance w between the teeth corresponds to the size of the rectangular carton, the carton will thus be held in a secure position by the conveyor track. The leading teeth 18 may also be provided with a protrusion 22 at the top of each tooth that will help to hold the carton in position. In the shown example, where the carton is counterfolded, the protrusion points towards the holding space of the conveyor track. In this way, the carton will not be able to spring back due to the built-in tension. Depending on the way the carton is erected and inserted, the protrusions may also be provided at the trailing teeth of the conveyor track.

In another example of the inventive carton feeding device, the erecting fingers will erect the carton blanks by an angle of less than 90 degrees. In this example, a carton is not opened completely before it is inserted into the holding space of the conveyor track. The angle $\alpha$ between the holding plane of the pick-up head and the bearing surface of the erecting fingers is in this embodiment between 100 and 140 degrees, and is preferably around 120 degrees. In this example, the hold down element 24 is essential, since the pretension in the carton will be in the direction to return the partly opened carton to the carton blank state, i.e. to retract.

When the carton is released from the pick-up head, it continues to travel with the conveyor track and the pick-up head continues its movement along the path shown in FIG. 7. FIG. 6 shows the pick-up head in a position where the carton is released and the pick-up head is on its way back to the pick-up position.

The shown carton feeding device is capable of reaching an insertion rate of up to 150 insertions per minute. When a higher insertion rate is desirable, the inventive carton feeding device is well suited to be assembled in groups of several carton feeding devices, thus allowing the insertion rate to increase. The carton feeding device is relatively compact in the lengthwise direction, i.e. in the travel direction of the conveyor track. It is thus possible to mount several carton feeding devices next to each other. When several carton feeding devices are mounted next to each other, every second holding space may be inserted with a carton at the same time. By mounting two groups of carton feeding devices next to each other, all holding spaces of the conveyor track may be filled.

Another advantage of dividing the insertion of cartons to several insertion devices is the feeding of cartons from the magazine. One problem that arises when the number of cartons that are to be inserted into a conveyor track is increased with a conventional feeding device using a single pick-up head, is the feeding of cartons to the pick-up head from the magazine. When feeding all the cartons from a single magazine, it is difficult to provide constant feeding properties for the carton. The pressure on the carton stack varies with the number of cartons, which affects the feeding of a carton to the feeding position. Since the lead time for picking up a carton is decreased, the timing for the suction heads is more sensitive which in turn makes it more difficult to provide an accurate pick-up of a carton. A shorter pick-up time calls for a lower holding force of the carton in the magazine, but a decrease in the holding force will affect the repeatability of the feeding of cartons. It is therefore an advantage to divide the feeding of cartons to several magazines. This will allow for a proper and accurate pick-up of a carton with a high repeatability.

Figure 9:
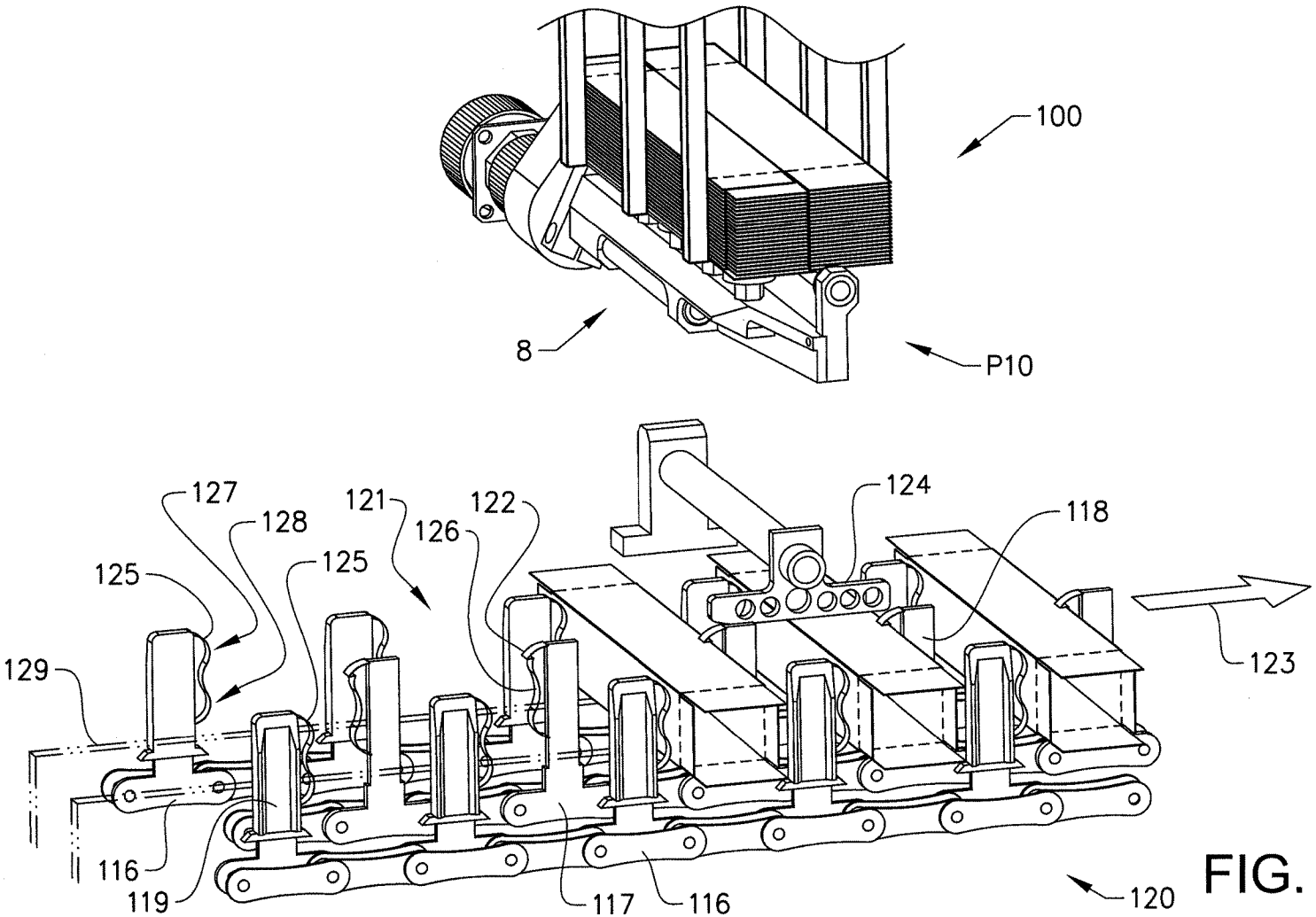
FIG. 9 shows a second embodiment of a carton feeding device used in a system according to the invention in a pick-up position.
Figure 10:
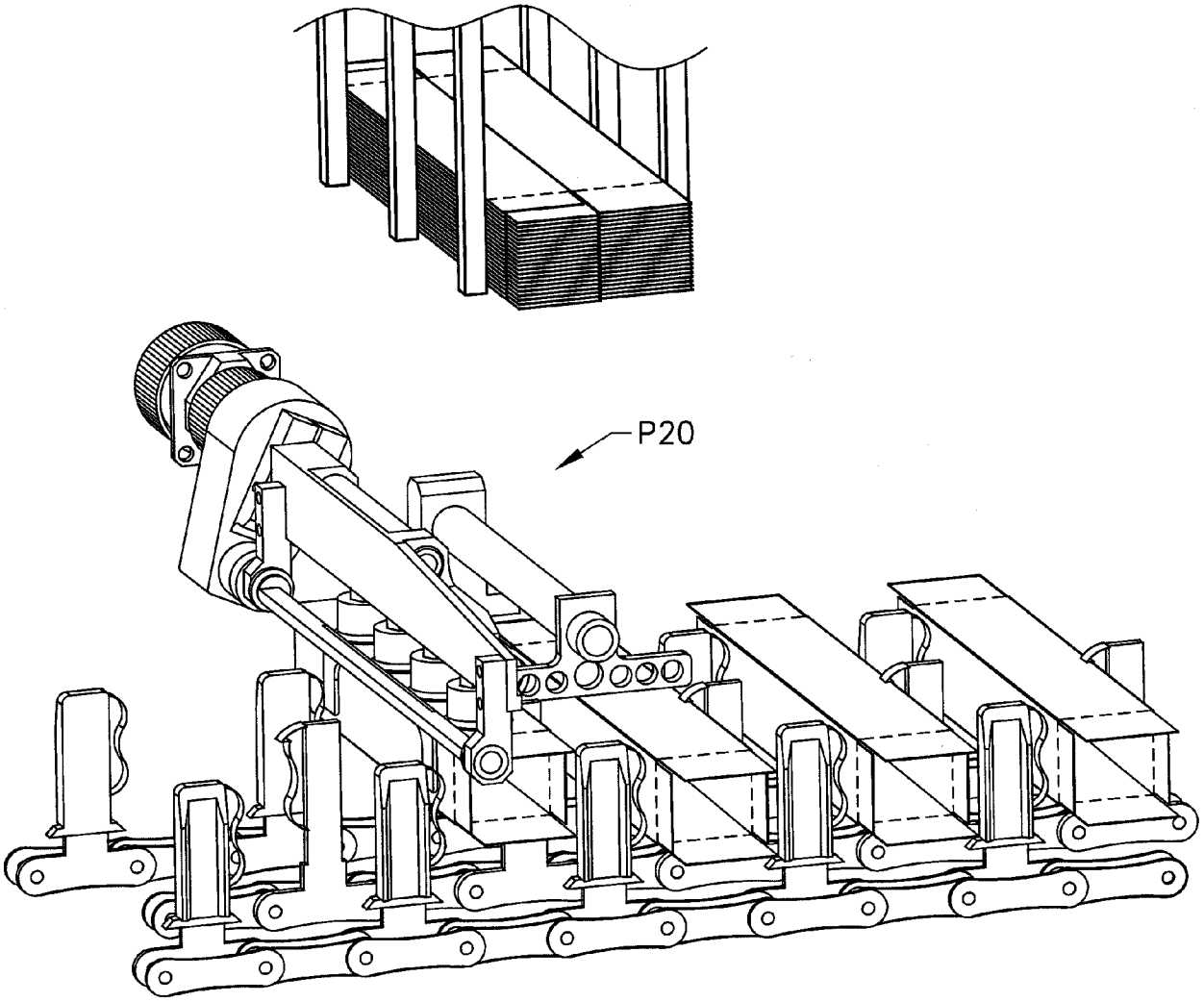
FIG. 10 shows a second embodiment of a carton feeding device used in a system according to the invention in an insertion position.

A second embodiment of a carton feeding device 100 is shown in FIGS. 9 and 10. The pick-up head is in this example that same as pick-up head 8 as described above. In FIG. 9, the pick-up position P10 is shown. This pick-up position is the same as P1 described above.

FIG. 9 also shows a conveyor track 120 having protruding teeth extending from the surface of the conveyor track. In this example, the conveyor track comprises two conveyor chains, an outer conveyor chain 116 consisting of two chains that travel fixed to each other, and an inner chain 117 that travels together with the outer chain. The outer chain is provided with trailing teeth 119 that will support the rear walls of the carton through a resilient element 125. The resilient element 125 protrudes from the forward face of the tooth and may be designed in different ways. In the shown example, a bend blade spring constitutes the resilient element. Other types of springs are also possible to use, as well as resilient materials and also rigid parts that are resiliently suspended in the tooth. The resilient element must be able to deflect such that the fully erected carton may be inserted. The purpose of the resilient element is to provide the required tolerances for the insertion of the carton. A deflection of at least 5 to 10% of the upper wall of the carton, i.e. the width of the fully erected carton, is thus necessary for each resilient element.

The shape of the bent spring is adapted to allow a fully erected carton to be inserted. The upper part of the resilient element constitutes an entrance region 127. This is shaped such that the carton can enter the holding space without damage and will deflect when the carton is inserted. The lower part of the resilient element constitutes a holding region 128 and will hold the carton in position when the carton is inserted and released from the pick-up head.

The inner chain is provided with leading teeth 118 that will support the front walls of the cartons through a resilient element 126. The resilient element 126 protrudes from the rearward face of the tooth and may be designed in different ways. In the shown example, the resilient element 126 resembles the resilient element 125. The resilient element 126 also comprises an entrance region 127 and a holding region 128. The resilient element 126 further comprises a holding protrusion 122 formed between the entrance region 127 and the holding region 128. The holding protrusion 122 will help to hold the carton in position and will prevent the carton from springing back due to the pretension in the carton. It is also possible to provide the resilient element 125 with holding protrusions.

Between the trailing teeth 119 and the leading tooth 118, a holding space 121 for a carton is created, in which the carton is inserted and further conveyed. The distance between the teeth are in this embodiment larger than the width of the erected carton, and the distance between the surfaces of the unloaded resilient elements 125 and 126 is smaller than the width of the erected carton. The resilient elements ensure that the cartons are securely held in place during the subsequent insertion of an object into the carton. A hold down element 124 may also in this embodiment be arranged to stop the inserted cartons from escaping upwards, out of the holding space. The moving direction of the conveyor track is indicated by an arrow 123. Two longitudinal rails 129 are arranged between the teeth in the lengthwise direction of the conveyor track, similar to the rails 25 described above.

In FIG. 10, the insertion position P20 is shown. In this embodiment, the carton is fully erected, i.e. the carton is rectangular, during the insertion. During the erection of the carton, it is possible to counterfold the carton by the erecting finger and then let the carton retract to the rectangular shape. This will help the carton to keep the rectangular shape after the insertion, since some pretension in the carton may deflect the resilient elements some. Before the insertion is started, the pick-up head 8 is thus rotated such that the holding plane is parallel to the conveyor track, with the angle β being substantially zero, and the erecting finger 12 is pivoted such that the carton is fully erected. The pick-up head starts to move along the conveyor track and at the same time, the pick-up head is lowered downwards such that the lower part of the carton reaches down between the resilient elements of the teeth. In FIG. 10, the lowermost position of the pick-up head is reached. The carton is released from the pick-up head and the hold down element 124 will push the carton down into the holding space such that the carton is held by the holding regions of the resilient elements.

The pick-up head will move with more or less the same speed as the conveyor track during the insertion of the carton. Small speed differences, e.g. due to an acceleration at the beginning of the insertion, are allowed since the resilient elements will provide a tolerance between the teeth and the carton.

When the carton is released from the pick-up head, it continues to travel with the conveyor track and the pick-up head continues its movement along its movement path, which resembles the path shown in FIG. 7.

In some cases, the glue that glues the carton together may also cause the carton blank to stick some such that it will be more difficult to erect the carton. The erecting fingers may then not be able to erect the carton without damage to the exterior of the carton. For this reason, the carton feeding device may be provided with an opening head 14, shown in FIG. 8, which will pre-open the carton. The opening head is in this example positioned at a fixed position and is provided with a plurality of vacuum cups 15 to which a negative pressure is applied in order to pre-open the carton. The movement path of the pick-up head is in this example adapted such that the lower wall 4 of the carton blank comes in contact with the vacuum cups 15. At the same time, a negative pressure is applied to the vacuum cups. When the pick-up head moves downwards somewhat, the vacuum cups 15 will hold the lower wall in a fixed position. Since the upper wall 3 is held by the vacuum cups 9 of the pick-up head, the carton will break up even if there is some residual glue in between the inner surfaces of the carton blank. The negative pressure of the vacuum cups 15 is then released and the erecting fingers start acting on the rear wall 6. The adapted movement path of the pick-up head is shown as a dashed line in FIG. 7. It is also possible to mount the opening head on a movable bracket such that the opening head can follow the movement of the carton to some extent during the opening of the carton.

Figure 11:
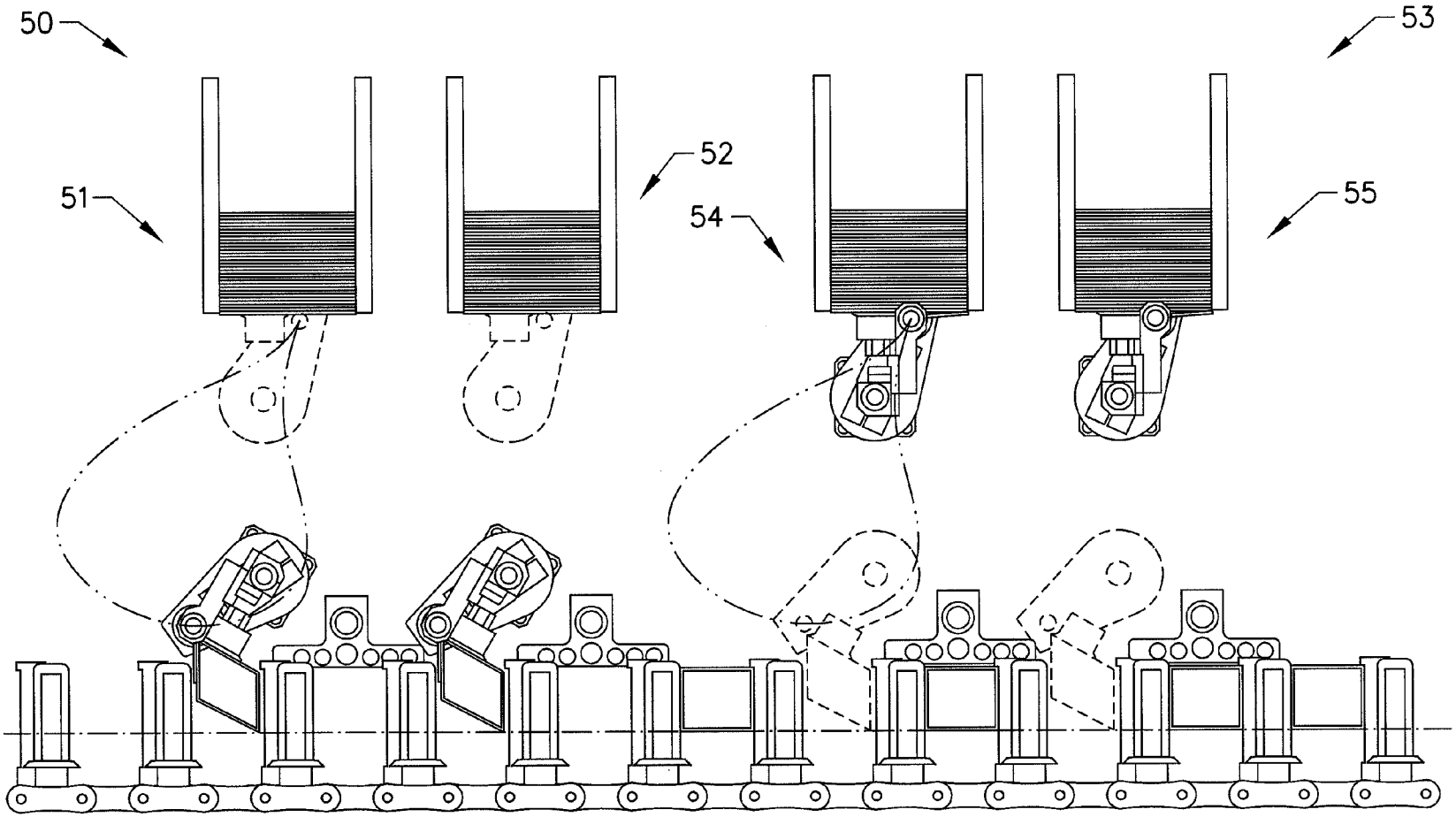
FIG. 11 shows an insertion system comprising four carton feeding devices according to a first embodiment of the invention.

In the inventive system, several feeding devices are mounted side by side along the conveyor track. A first embodiment of the inventive system is shown in FIG. 11. In this embodiment, the cartons are counterfolded to a rhombic shape when they are inserted into the holding spaces. In the shown example, the system consists of two groups of feeding devices 1 as described above, where each group consists of two feeding devices. The first group 50 comprises a first feeding device 51 and a second feeding device 52. The second group 53 comprises a third feeding device 54 and a fourth feeding device 55. The feeding devices of the first group are spaced apart in the horizontal direction in such a way that the pick-up heads inserts a carton in every second holding space of the conveyor track. The feeding devices of the second group are spaced apart in the same way as the first group. The second group is spaced apart some from the first group in the horizontal direction. The pick-up heads of the second group will insert a carton in the void holding spaces of the conveyor track, i.e. in every other holding space. Thus, the first and the second group of feeding devices will fill all holding spaces of the conveyor track.

Figure 12:
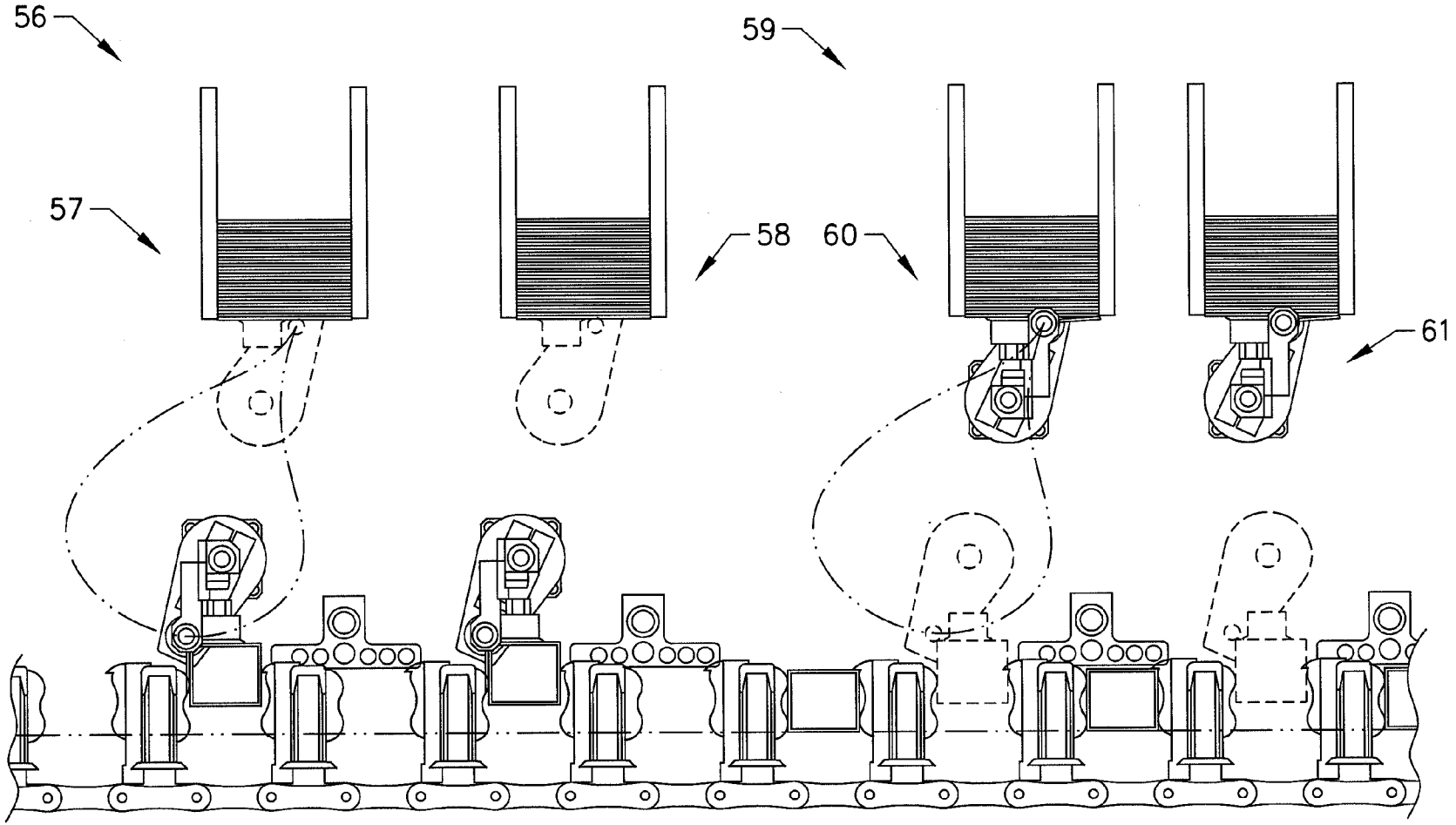
FIG. 12 shows an insertion system comprising four carton feeding devices according to a second embodiment of the invention.

A second embodiment of the inventive system is shown in FIG. 12. In this embodiment, the cartons are fully erected when they are inserted into the holding spaces. In the shown example, the system consists of two groups of feeding devices 101 as described above, where each group consists of two feeding devices. The first group 56 comprises a first feeding device 57 and a second feeding device 58. The second group 59 comprises a third feeding device 60 and a fourth feeding device 61. The feeding devices of the first group are spaced apart in the horizontal direction in such a way that the pick-up heads inserts a carton in every second holding space of the conveyor track. The feeding devices of the second group are spaced apart in the same way as the first group. The second group is spaced apart some from the first group in the horizontal direction. The pick-up heads of the second group will insert a carton in the void holding spaces of the conveyor track, i.e. in every other holding space. Thus, the first and the second group of feeding devices will fill all holding spaces of the conveyor track.

In the inventive system, it is possible to insert a plurality of cartons at the same time. In this way, it is easy to adapt the number of cartons that are to be inserted by altering the number of used feeding devices. By using two groups of feeding devices, it is also possible to fill every holding space of the conveyor track. This increases the efficiency of the system since more cartons can be processed in the same time. It is possible to use different numbers of feeding devices in a feeding system, and to group them in different numbers of groups.

The inventive solution allows for a high insertion rate of the system. In one preferred example, eight feeding devices grouped in two groups are used, where each carton feeding device is capable of inserting up to 150 cartons per minute, which results in a complete insertion system capable of inserting 1200 cartons per minute. The first group inserts a carton in every second holding space and the second group inserts a carton in every other holding space. In this way, a compact, fast and reliable insertion station is obtained. In order to increase the throughput further, it would be possible to e.g. use three groups of feeding devices spaced apart by two cartons each, with each group comprising four feeding devices. When each group inserts every third carton, a throughput of 1800 cartons per minute could be reached. Depending on the requirements of the system, other number of groups with other numbers of feeding devices is also possible to use.

The invention is not to be regarded as being limited to the embodiments described above, a number of additional variants and modifications being possible within the scope of the subsequent patent claims. It is e.g. possible to arrange the pick-up heads in more groups than two and to use any number of pick-up heads in a group. It is also possible to position the erecting fingers on the other side of the pick-up heads, i.e. to mirror-invert the pick-up heads.

REFERENCE SIGNS

1: Carton feeding device
2: Carton
3: Upper wall
4: Lower wall
5: Front wall
6: Rear wall
7: Magazine
8: Pick-up head
9: Vacuum cup
10: Base part
11: Erecting shaft
12: Erecting finger
13: Bearing surface
14: Opening head
15: Vacuum cup
16: Outer chain
17: Inner chain
18: Leading tooth
19: Trailing tooth
20: Conveyor track
21: Holding space
22: Protrusion
23: Moving direction
24: Hold down element
25: Rail
50: First group of feeding devices
51: First feeding device
52: Second feeding device
53: Second group of feeding devices
54: Third feeding device
55: Fourth feeding device
56: First group of feeding devices
57: First feeding device
58: Second feeding device
59: Second group of feeding devices
60: Third feeding device
61: Fourth feeding device
100: Carton feeding device
116: Outer chain
117: Inner chain
118: Leading tooth
119: Trailing tooth
120: Conveyor track
121: Holding space
122: Protrusion
123: Moving direction
124: Hold down element
125: Resilient element
126: Resilient element
127: Entrance region
128: Holding region
129: Rail

The invention claimed is:

1. A carton feeding system for feeding a plurality of cartons to a conveyor track, comprising:

a plurality of feeding devices, where each feeding device comprises:

a pick-up head with a plurality of vacuum cups each having a front, the front of the plurality of vacuum cups defining a holding plane, the pick-up head being moveable between:

a pick-up position (P1) in which the holding plane of the pick-up head is positioned parallel to a folded carton blank that is to be picked up, and an insertion position (P2) in which the carton blank is oriented for insertion into the conveyor track, and an erecting finger having a bearing surface and pivotally suspended at the pick-up head, wherein the erecting finger is pivotal with respect to the holding plane of the pick-up head between:

a first position in which the bearing surface of the erecting finger is substantially parallel to the holding plane when the pick-up head is in the pick-up position (P1) such that the erecting finger supports the folded carton blank received on the holding plane of the pick-up head, and a second position in which the bearing surface is transverse to the holding plane of the pick-up head when the pick-up head is in the insertion position (P2) to engage the carton blank and at least partially open the carton blank and align the erecting finger with the conveyor for insertion of the carton into the conveyor, wherein the pick-up head and the erecting finger are released from the carton blank at the insertion position (P2) when the carton is inserted into the conveyor;

wherein at least two of feeding devices of the plurality of feeding devices are operable in parallel to insert and release at least two cartons simultaneously at respective ones of the insertion positions (P2) located along the conveyor track.

2. The system according to claim 1, wherein the feeding devices are grouped in two groups, where each group inserts every other of the cartons to be inserted.

3. The system according to claim 1, wherein the holding plane of the pick-up head is tilted with an angle β when the carton is inserted in the insertion position (P2), where β is the angle between the holding plane of the pick-up head and a plane parallel to the conveyor track, and β is between 10 and 40 degrees.

4. The system according to claim 1, wherein the carton is shaped as a rhomb with an angle α between an upper wall and a side wall a when the carton is inserted into the conveyor track, where α is between 50 and 80 degrees.

5. The system according to claim 1, wherein the distance between a leading teeth and a trailing teeth of the conveyor track is substantially equal to the width w of an upper wall of the carton.

6. The system according to claim 5, wherein the at least one teeth or one resilient means is provided with a holding protrusion adapted to bear at one edge of the carton when the carton is inserted into the conveyor track.

7. The system according to claim 1, wherein the holding plane of the pick-up head is parallel to the conveyor track when the carton is inserted in the insertion position (P20).

8. The system according to claim 7, wherein the carton is rectangular when the carton is inserted into the conveyor track.

9. The system according to claim 7, wherein the distance between a leading teeth and a trailing teeth of the conveyor track is greater than the width w of an upper wall of the carton and that the teeth comprises resilient means that will bear on the carton when the carton is inserted between the teeth.

10. The system according claim 1, wherein each feeding device further comprises a hold down element above the conveyor track which moves with the pick-up head in the horizontal direction.

11. The system according to claim 1, wherein each feeding device further comprises an opening head provided with vacuum cups.

12. The system according to claim 1, wherein the system comprises eight feeding devices, where the feeding devices are grouped in two groups each containing four feeding devices.

* * * * *